US005168779A

United States Patent [19]

Cassidy

[11] Patent Number: 5,168,779

[45] Date of Patent: Dec. 8, 1992

[54] VIDEOTAPE CASSETTE CASE OPENER, AND METHOD OF USING IT

[75] Inventor: Kevin Cassidy, Northport, N.Y.

[73] Assignee: Brodart Co., Williamsport, Pa.

[21] Appl. No.: 844,179

[22] Filed: Mar. 2, 1992

[51] Int. Cl.[5] ..... B67B 7/00

[52] U.S. Cl. ..... 81/3.47; 81/3.25; 81/485; 81/488

[58] Field of Search ..... 81/3.47, 3.25, 3.27, 81/3.55, 3.07, 3.48, 488, 485

[56] References Cited

U.S. PATENT DOCUMENTS

| | | | |
|---|---|---|---|
| 1,431,708 | 10/1922 | Tisdale et al. | 81/485 |
| 2,675,721 | 4/1954 | Kramer et al. | 81/3.55 |
| 2,764,160 | 9/1956 | Alexander et al. | 81/485 |
| 2,799,082 | 7/1957 | Mann | 81/485 |
| 3,290,967 | 12/1966 | Stark | 81/3.55 |
| 3,954,030 | 5/1976 | Newton | 81/3.55 |

*Primary Examiner*—Roscoe V. Parker
*Attorney, Agent, or Firm*—Alan H. Levine; Howard F. Mandelbaum

[57] ABSTRACT

An opener for a videotape cassette case of the type having a body and a cover hinged to the body, the body and cover presenting two parallel spaced-apart flanges when the case is closed. The opener includes a rigid element, which may be a flat plate, having a shoulder portion wider than the spacing between the case flanges when the case is closed, the shoulder portion tapering toward a nose portion which is narrower than the spacing between the case flanges when the case is closed. A closed videotape cassette case is opened by inserting the nose portion of the opener into one end of the space between the flanges and moving the case with respect to the opener so as to bring the shoulder portion between the flanges to urge the flanges apart. Continued movement of the case with respect to the shoulder portion of the opener causes the flanges to progressively separate from each other so as to pry the cover from the body and thereby open the case. The opener is mounted on a stationary surface so that the case can be opened simply by running the side of the case presenting the flanges along the opener.

4 Claims, 1 Drawing Sheet

VIDEOTAPE CASSETTE CASE OPENER, AND METHOD OF USING IT

This invention relates to container openers, and more particularly to an opener for a videotape cassette case.

When videotapes are rented from videotape rental establishments, such as video stores and libraries, the video-tape cassette is placed into a plastic case so as to protect it. The patron transports the cassette home and returns it within the protective case. These cases are designed to snap shut very tightly so as to guard against accidental opening of the case which might permit the cassette to fall out and become damaged.

In order to permit the case to be opened, the body of the case, and the cover hinged to it, are sized so that they present two parallel flanges which can be grasped and pulled apart to swing the cover away from the body so as to open the case. However, despite the presence of the flanges, videotape cassette cases are quite difficult to open. For the patron, this difficulty may amount to nothing more than a nuisance and an occasional broken fingernail. However, to employees of video rental establishments, who must open as many as thousands of these cases each month, the difficulty in prying open videotape cassette cases represents a serious problem, involving not only broken finger nails, but bruised fingers, sprained wrists, and tendinitis.

It is an object of the present invention to provide a videotape cassette case opener which avoids the need for prying such cases open by hand.

It is another object of the invention to provide such an opener which permits a videotape cassette case to be opened while holding the case in just one hand.

It is a further object of the invention to provide such an opener which can be permanently mounted on a stationary support surface, such as a wall, desk top, or counter top, and which will be unobtrusive when so mounted.

It is an additional object of the invention to provide such an opener which is simple to use, and easy to manufacture on a mass-production basis.

Concomitantly, it is an object of the invention to provide a method of opening a videotape cassette case by simply running the side of the case, opposite the cover hinge, along the opener of this invention.

Other objects and features of the present invention will be apparent from the following description in which reference is made to the accompanying drawings.

In the drawings:

FIG. 1 perspective view of a video tape cassette case, the cover of the case being shown ajar;

Figure 1:
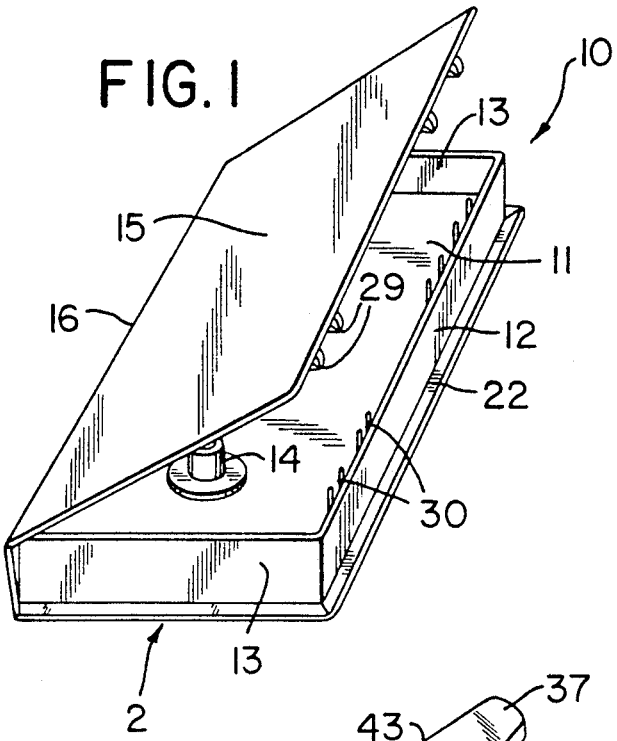
Figure 2:
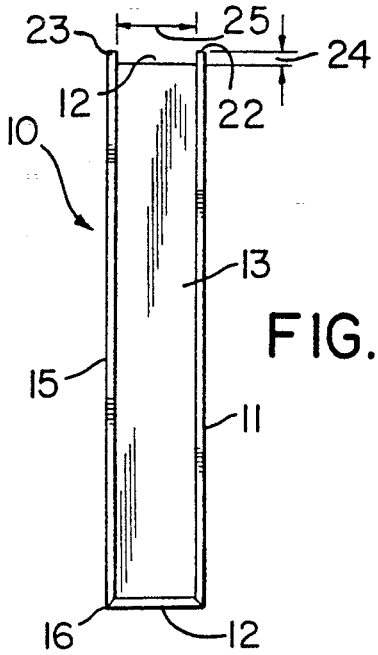
FIG. 2 is an end view of the case, looking in the direction of the arrow 2 in FIG. 1.

A typical videotape cassette case 10 illustrated in FIGS. 1 and 2 is a plastic box including a back wall 11, side walls 12, and end walls 13. The walls 11, 12, and 13 comprise the body of the case 10 into which a cassette is placed. In this connection, one or two positioning hubs 14 usually project into the interior of the case and are accommodated by the holes in the tape spools within the cassette. Hinged at 16 along the free edge of one of the side walls 12 is the case cover 15.

Back wall 11 is larger than the area circumscribed by case walls 12 and 13, so that a margin of back wall 11 projects beyond the side wall 12, opposite hinge 16, to define a flange 22. Cover 15 is the same size as back wall 11, and hence when the case 10 is closed, a margin of cover 15 also extends beyond side wall 12 to define a flange 23. The width of flanges 22 and 23, i.e., the distance that wall 11 and cover 15 extend beyond wall 12, is indicated in FIG. 2 by the reference numeral 24. The spacing between the parallel flanges 22 and 23, when the cassette case is closed, is equal to the height of walls 12 and 13, and indicated by reference numeral 25 in FIG. 2.

When the cover 15 of case 10 is closed, detents 29 on the cover snap tightly into slots 30 carried by side wall 12 opposite hinge 16. It is prying detents 29 out of slots 30 which makes opening the case so difficult.

Figure 3:
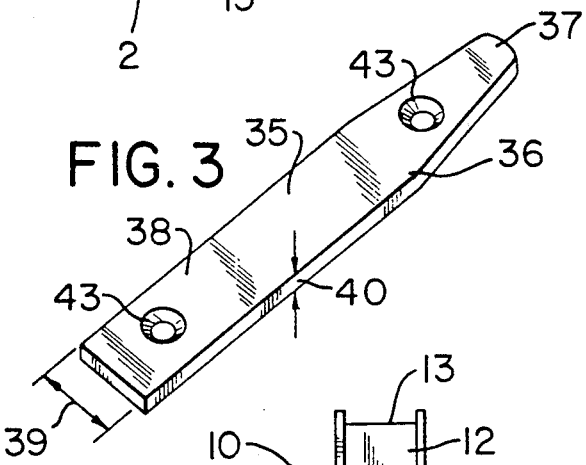
FIG. 3 is a perspective view of a video tape cassette case opener according to, the present invention.

One example of a videotape cassette case opener according to the present invention, and the preferred embodiment, is illustrated in FIG. 3. The opener 35 includes a flat, rigid plate of any suitable material, such a metal, wood, or rigid plastic. Opener 35, near one of its ends, has a shoulder portion 36. From the shoulder portion, the opener tapers toward a narrower nose portion 37 at one of its ends. The remainder of opener 35 is an extension 38 which extends from shoulder portion 36 in the direction opposite to nose 37. The sides of extension 38 are preferably parallel so that the width of extension 38 is no greater than the maximum width of shoulder portion 36. The width of extension 38, and hence the maximum width of shoulder 36, is indicated at 39 in FIG. 3. The width 39 of opener 35 is sufficiently greater than the spacing 25 between flanges 22 and 23 so that when shoulder portion 36 of opener 35 enters between flanges 22 and 23, the flanges are moved apart sufficiently to pry open the cassette case 10. The thickness 40 (FIG. 3) of opener 35 is preferably about equal to the width 24 of the cassette case flanges. By way of example, an opener according to the invention may have a length of about eight inches, a width 39 of about one and a quarter inches, and a thickness 40 of about one eighth of an inch. The width of nose 37 is substantially less than the spacing 25 between flanges 22 and 23.

Opener 35 is may be provided with two countersunk holes 43 adapted to accommodate two flat head screws 44 (FIG. 4) for mounting opener 35 on a stationary support surface, such as a wall, a desktop, or a countertop. Since the holes 40 are countersunk, the heads of the screws will be flush with the surface of opener 35 when mounting is complete. Obviously, other means for mounting opener 35 can be employed, such as nails or other fasteners, or a suitable adhesive.

Figure 4:
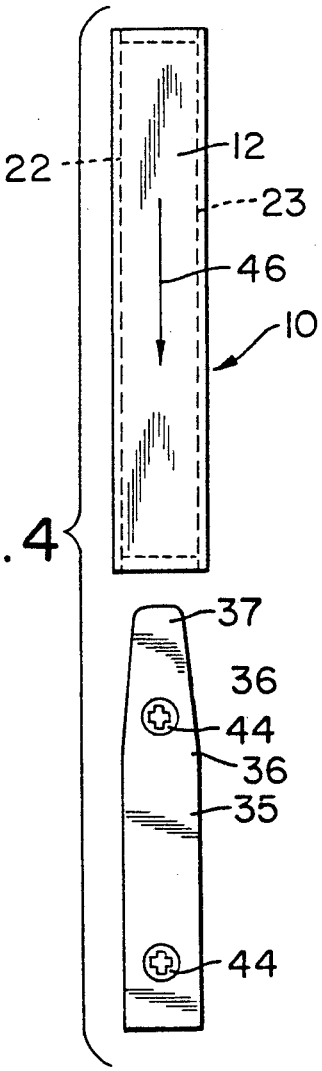
FIG. 4 is face view of the mounted case opener showing the position in which the video tape cassette case is placed just prior to employing the opener.
Figure 5:
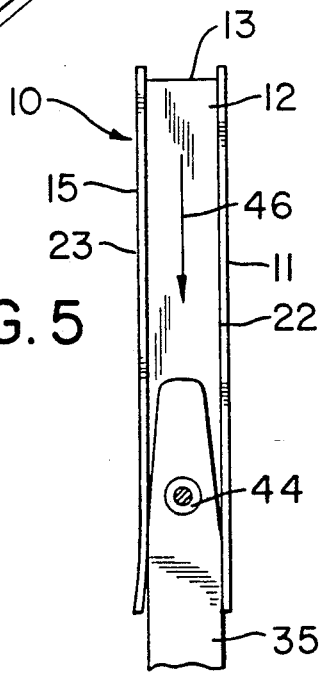
FIG. 5 is a view similar to FIG. 4, but from the direction of the surface on which the opener is mounted, showing the cooperation of the opener and case during the case-opening procedure.

The manner in which video tape cassette case lo is opened by means of opener 35 is illustrated in FIGS. 4 and 5. In the illustration, opener 35 is mounted on a wall with its nose portion 37 pointing upwardly. A case 10 to be opened is held above opener 35 with the edges of flanges 22 and 23 against the wall. In this position, nose 37 is facing one end of the space between flanges 22 and 23. In addition, opener 35 and flanges 22 and 23 are all in the same vertical plane.

To open the case, the case is moved downwardly, in FIG. 4, in the direction of arrow 46. Nose portion 37 and the tapered region of opener 35 between the nose portion and shoulder portion 36 guide the lower ends of flanges 22 and 23 onto shoulder portion 36, which as pointed out above, is wider than the spacing between the flanges. As a result, as indicated in FIG. 5 (which is a view looking from the wall on which the opener is mounted), flange 23 of cover 15 is pried away from flange 22. As case 10 continues to be moved in the direction of arrow 46, flange 23 is progressively pried away from flange 22 causing detents 29 to be popped out of slots 30 thereby freeing cover 15 from side wall 12 and permitting it to be swung about hinge 16 to open the case.

It will be appreciated that the opener of the present invention permits a videotape cassette case to be opened without the need for prying flanges 22 and 23 apart using the fingers of two hands, and further the opener permits the case to be opened while holding the case in just one hand as its length is moved along opener 35.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. An opener for a videotape cassette case, the case having a body and a cover hinged to the body, and the body and cover presenting two parallel spaced apart flanges when the case is closed, the opener comprising a rigid flat plate having a thickness about equal to the width of the case flanges, the plate having a shoulder portion wider than the spacing between the case flanges when the case is closed, and the shoulder portion tapering toward a nose portion which is narrower than the spacing between the case flanges when the case is closed, whereby a closed videotape cassette case can be opened by inserting the nose portion of the opener into the end of the space between the flanges and moving the case with respect to the opener so as to bring the shoulder portion between the flanges, continued movement of the case with respect to the shoulder portion causing the flanges to progressively separate from each other so as to pry the cover from the body and thereby open the case.

2. An opener for a videotape cassette case, the case having a body and a cover hinged to the body, and the body and cover presenting two parallel spaced apart flanges when the case is closed, the opener comprising a rigid element having a shoulder portion wider than the spacing between the case flanges when the case is closed, and the shoulder portion tapering toward a nose portion which is narrower than the spacing between the case flanges when the case is closed, whereby a closed videotape cassette case can be opened by inserting the nose portion of the opener into the end of the space between the flanges and moving the case with respect to the opener so as to bring the shoulder portion between the flanges, continued movement of the case with respect to the shoulder portion causing the flanges to progressively separate from each other so as to pry the cover from the body and thereby open the case, and means for securing the rigid element to a stationary support surface.

3. An opener for a videotape cassette case, the case having a body and a cover hinged to the body, and the body and cover presenting two parallel spaced apart flanges when the case is closed, the opener comprising a rigid element having a shoulder portion wider than the spacing between the case flanges when the case is closed, and the shoulder portion tapering toward a nose portion which is narrower than the spacing between the case flanges when the case is closed, whereby a closed videotape cassette case can be opened by inserting the nose portion of the opener into the end of the space between the flanges and moving the case with respect to the opener so as to bring the shoulder portion between the flanges, continued movement of the case with respect to the shoulder portion causing the flanges to progressively separate from each other so as to pry the cover from the body and thereby open the case, and an extension extending from the shoulder portion in the direction opposite to the direction in which the nose portion extends from the shoulder portion, the extension being no wider than the shoulder portion, and means for securing the extension and shoulder portion to a stationary support surface.

4. A method of opening a videotape cassette case, the case having a body and a cover hinged to the body, and the body and cover presenting two parallel spaced apart flanges when the case is closed, the method comprising the steps of providing a rigid opener having a shoulder portion wider than the spacing between the case flanges when the case is closed, the shoulder portion tapering toward a nose portion which is narrower than the spacing between the case flanges, inserting the nose portion into one end of the space between the flanges , and moving the case with respect to the opener so as to bring the shoulder portion between the flanges to progressively pry the flanges apart and thereby open the case.

* * * * *